United States Patent [19]

Hederer et al.

[11] Patent Number: 4,970,806

[45] Date of Patent: Nov. 20, 1990

[54] PROCESS AND DEVICE FOR CONDITIONING BULK MATERIAL

[75] Inventors: Harmut Hederer, Dortmund; Manfred Kreft, Wetter; Wolfgang Hillebrand, Dortmund, all of Fed. Rep. of Germany

[73] Assignee: UHDE GmbH, Fed. Rep. of Germany

[21] Appl. No.: 261,019

[22] Filed: Oct. 21, 1988

Related U.S. Application Data

[63] Continuation-in-part of Ser. No. 125,230, Nov. 25, 1987, Pat. No. 4,785,554.

[30] Foreign Application Priority Data

Oct. 23, 1987 [DE] Fed. Rep. of Germany ..... 3735954

[51] Int. Cl.[5] ..... F26B 9/00

[52] U.S. Cl. ..... 34/164; 34/178

[58] Field of Search ..... 34/171, 172, 164, 178, 34/176

[56] References Cited

U.S. PATENT DOCUMENTS

| | | | |
|---|---|---|---|
| 3,710,453 | 1/1973 | Whelpley | 34/171 |
| 3,742,614 | 7/1973 | Bettermann et al. | 34/164 |
| 4,392,301 | 6/1983 | Hohman et al. | 34/172 |
| 4,785,554 | 11/1988 | Hederer et al. | 34/164 |

*Primary Examiner*—Henry A. Bennet
*Assistant Examiner*—John Sollecito
*Attorney, Agent, or Firm*—Marshall & Melhorn

[57] ABSTRACT

Bulk material containing vaporizable ingredients, such as lignite, hard coal, peat, waste wood, clarifier sludge, waste sludge, contaminated earth, catalysts, zeolites and filter cake, is conditioned by means of a vibrating plate conveyor divided into a heating section and a drying section, using an indirect heat exchange method. The bulk material is heated in an enclosed heating section while withdrawing the vapor from this section. In the downstream enclosed drying section, the vaporizable fractions contained in the bulk material are further reduced with the aid of heat supplied indirectly, the vapor being withdrawn. The bulk material is separated several times into coarse and fine fractions utilizing at least one slotted grid, the fines being immediately recycled and remixed with the coarse fractions which have a higher water content. The bulk material is mixed several times while being heated in the drying section before discharge. Substantial improvement in the conditioning of bulk material having a wide grain size distribution is achieved by adding fine-grain auxiliary material to the bulk material containing vaporizable fractions in a very early stage of the process.

3 Claims, 2 Drawing Sheets

PROCESS AND DEVICE FOR CONDITIONING BULK MATERIAL

This is a continuation-in-part of co-pending application Ser. No. 125,230, filed Nov. 25, 1987, now U.S. Pat. No. 4,785.554.

BACKGROUND OF THE INVENTION

The invention relates to a device for conditioning bulk material such as lignite, hard coal, activated carbon, peat, waste wood. clarifier sludge, waste sludge, contaminated earth, catalysts, zeolites and filter cake, which contain vaporizable fractions, the flow of the material being maintained by means of a vibrating plate conveyor and the material being treated in a heating section and a downstream drying section, using an indirect heat exchange method. Such a process and device are described in U.S. Pat. No. 4,785,554, the disclosure of which is specifically incorporated herein by reference.

Use of the device described in the aforementioned patent has shown that the bulk material to be treated is not always supplied in a state which offers favorable conditioning properties.

SUMMARY OF THE INVENTION

An object of the invention is to provide a substantial improvement of the conditioning properties of bulk material with a wide grain-size distribution and a plurality of physical properties, whereby the improved characteristics are achieved in a very early stage of the conditioning process.

Another object of the invention is to achieve such improvement by mixing a fine-grain auxiliary material with the bulk material.

BRIEF DESCRIPTION OF THE DRAWINGS

The above objects and advantages of the invention will become readily apparent to those skilled in the art from reading the following detailed description of an embodiment of the invention when considered in the light of the accompanying drawings, in which.

DETAILED DESCRIPTION OF THE PREFERRED EMBODIMENT

The invention has a multitude of advantages. The essential advantage is that, pursuant to the disclosure of U.S. Pat. No. 4,785,554, it is also possible to condition bulk materials which previously could not be treated in vibrating conveyors. Thus, in accordance with the present invention, mixing the bulk material with a fine-grain auxiliary material in the heating and/or drying sections substantially improves the heat transfer from the vibrating plates onto said materials. The penetration of the hot fines through the layer of coarser bulk material depends on the grain size distribution and the difference in bulk densities, the hot fines falling from the upper plate and mixing with the coarser fractions. The conditioning process is controlled via a special metering system for the admixture of the auxiliary material.

According to a preferred embodiment of the invention, different portions of auxiliary material are added to the bulk material, preferably 5 to 25% by weight. The grain size of the material should be $<1$ mm, preferably 0.02 to 0.05 mm. If the auxiliary material cannot be further processed with the dry bulk material it is not remixed with the dry bulk material after the last separation.

If the bulk material to be conditioned cannot be dumped at the high drying temperature, the hot bulk material mixed with the auxiliary material is, according to a further embodiment of the invention, fed directly to a cooling section of the vibrating plate conveyor in which the material is directly cooled to at least 60° C. under an inert gas blanket.

The above process is particularly suitable for the device according to our aforementioned U.S. Patent, which describes the process and apparatus upon which the present invention is predicated.

Figure 1:
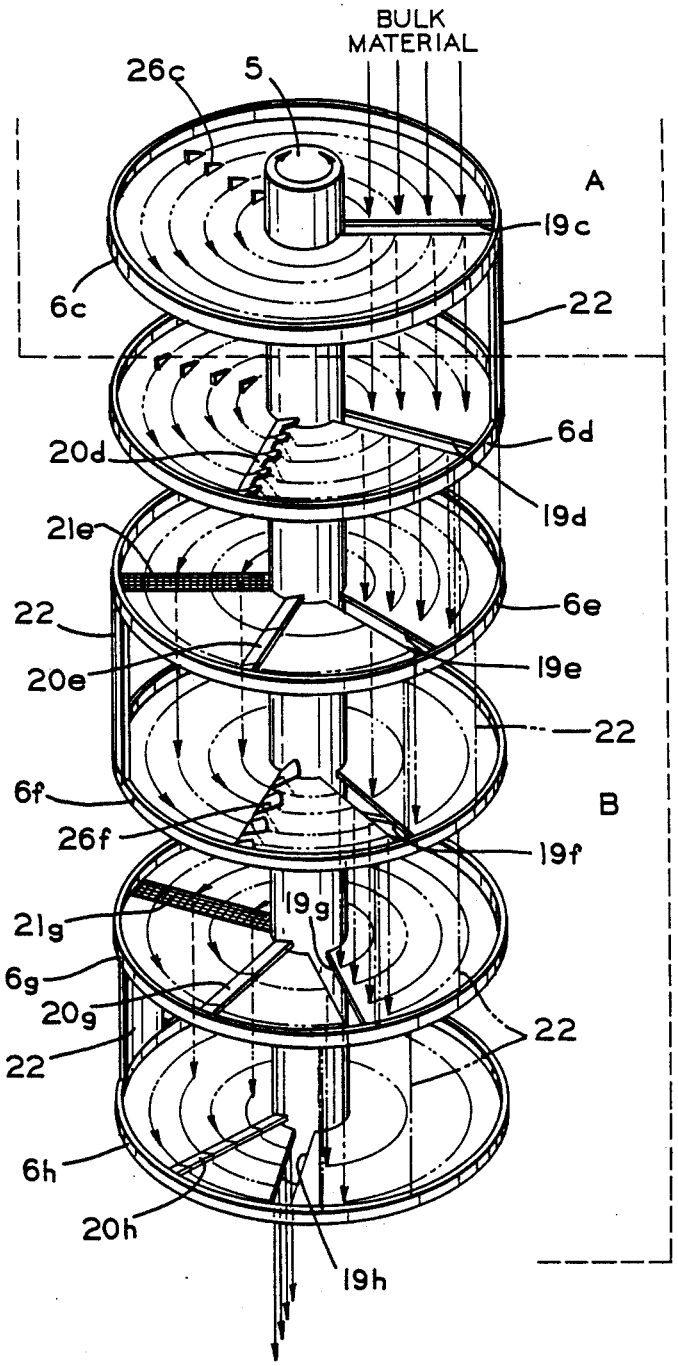
FIG. 1 is a perspective view of the vibrator shaft and heated plates of an apparatus utilized for conditioning bulk material in accordance with the invention.

Thus, there is illustrated in FIG. 1 a vibrator shaft and heated plates in accordance with the present invention, which correspond to the vibrator shaft and heated plates as illustrated in FIG. 6 of the patent and which are likewise adapted for incorporation in the drier structure of the patent. More particularly, a vertically extending vibrator shaft 5 extends through and is attached to a plurality of stacked, spaced apart, generally horizontally extending heated plates and identified individually at 6*c* through 6*h*. Each plate has a radially extending discharge opening 19 therein, the openings being identified at 19*c* through 19*h*. Thus, the bulk material deposited on the uppermost plate 6*c*, as it traverses the vibrating plate in the direction of the arrows, remains on the plate for one round until it reaches a discharge opening 19*c* whereupon it falls upon the upper surface of the succeeding plate. In traversing certain of the plates the material is mixed by mixing jibs 20, selected ones of which may have a serrated edge shape as shown at 20*d*, so that with the material of different grain sizes the concentration of fines increases in the lower part of the material stream and the coarse fractions accumulate in the upper part of the stream.

The plates 6*e* and 6*g*, for example, may have slotted grids 21*e* and 21*g* spaced from the corresponding discharge openings 19*e* and 19*g*, respectively, and extending from the vibrator shaft 5 to the peripheral edges of the plates for concentrating the fines in the lower part of the stream as described in the aforementioned patent. In order to reduce the discharge of dust caused by the vapor in the areas of the mixing jibs, slotted grids and discharge openings, cylindrical wall segments, shown at 22, may be provided between selected portions of the plates 6. The heating and drying sections of the unit are identified at "A" and "B", respectively.

Figure 2A:
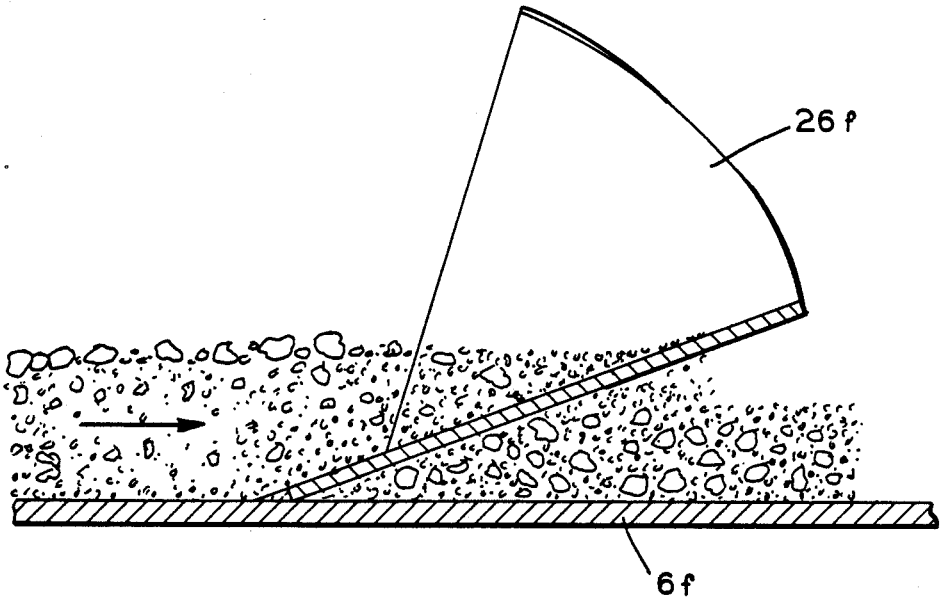
FIGS. 2*a* and 2*b* are enlarged, fragmentary cross sectional and top plan views, respectively, of the blades utilized in the apparatus illustrated in FIG. 1
Figure 2B:
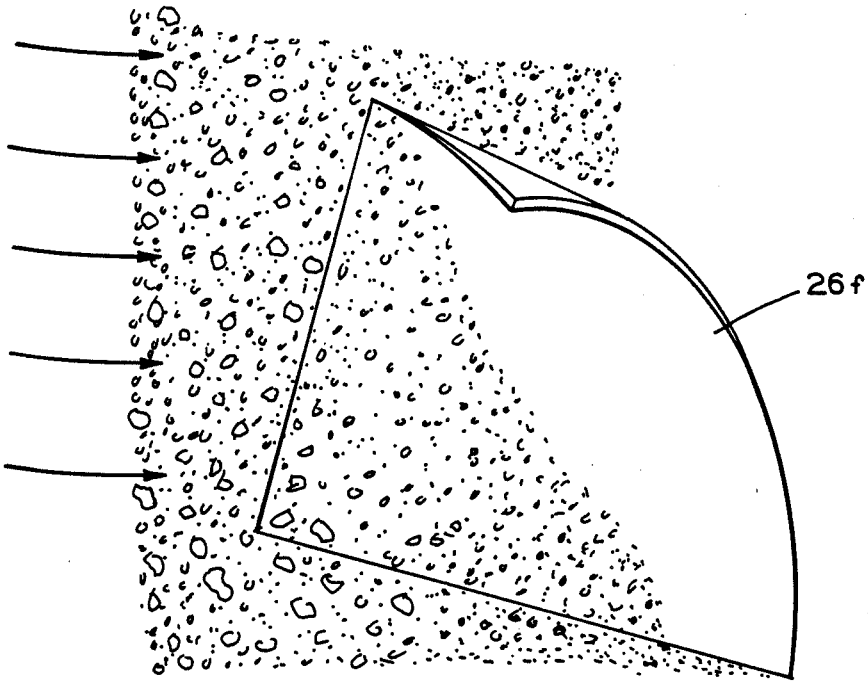

Straight and/or bent blades 26 of plough-share shape are mounted in the sense of rotation and radially spaced on one or several vibrating plates. It is thus possible to also treat moist bulk material which normally would cause the formation of cakes on said plates, but when the cakes form they are cut by the blades and can be well mixed with the fine-grain auxiliary material. There is shown in FIG. 1 a device which has such blades 26*c*, 26*d* and 26*f* mounted on plates 6*c*, 6*d* and 6*f*, respectively. FIGS. 2*a* and 2*b* show a cross-sectional and a top plan view, respectively, of the blades, which simultaneously serve as mixing jibs.

When fuels such as wet lignite, hard coal, etc., for example, are to be dried, and lime or dolomite is to be added during the combustion process, the lime or dolomite may already be used as auxiliary material for conditioning the fuel, such as the coal.

Similar process modifications have to be implemented when, for instance, moist bulk material further processed with the aid of a reactant has to be dried prior to the reaction process, adding said reactant in the form of fines.

Apart from auxiliary material that is neutral or inactive during the drying process, there are also active auxiliary materials which can absorb moisture because of their structure and/or properties, thus accelerating the conditioning process. Molecular sieves, activated carbon, etc. are suitable in this respect.

When selecting suitable auxiliary materials of adequate grain size, it is possible to achieve maximum heat transfer values of a $=300$ to 800 $W/M^2/°C$. from the vibrating plates into the auxiliary material and consequently, a large amount of heat is transferred from the auxiliary material onto the bulk material.

If the fine-grain auxiliary material cannot become an ingredient of the conditioned bulk material, the auxiliary material can be separated by a known method and recycled.

What is claimed is:

1. Apparatus for conditioning bulk material containing vaporizable ingredients, comprising a vertical vibrating plate dryer having a plurality of generally horizontally extending, circular plates, each of said plates being formed with at least one discharge opening therein, said plates being mounted in spaced-apart relation along a generally vertically extending vibrating shaft passing through a central portion of each of said plates whereby bulk material on said plates is caused to advance in circumferential paths around said shaft "in tangential orientation to said circumferential paths", at least one of said circular plates being equipped with a plurality of blades of plow share shape, said blades having a base being mounted in the sense of rotation and radially spaced from one another, at least one of said plates having a radially extending slot-type grid formed therein for passing a fine fraction of the bulk material and for preventing passage of a coarse fraction of the bulk material, and mixing jibs on at least one of said plates, said mixing jibs being of a serrated shape.

2. An apparatus for conditioning bulk material as claimed in claim 1, wherein said blades of plow share shape are straight.

3. An apparatus for conditioning bulk material as claimed in claim 1, wherein said blades of plow share shape are bent.

* * * * *